US006332421B1

(12) United States Patent
Leonard et al.

(10) Patent No.: US 6,332,421 B1
(45) Date of Patent: Dec. 25, 2001

(54) BOAT FENDER SYSTEM AND METHOD

(76) Inventors: Larry Leonard, 6 Lighthouse Ct.; Frank Lucchesi, 14 Lighthouse Ct., both of Napa, CA (US) 94559

( * ) Notice: Subject to any disclaimer, the term of this patent is extended or adjusted under 35 U.S.C. 154(b) by 0 days.

(21) Appl. No.: 09/593,374

(22) Filed: Jun. 15, 2000

(51) Int. Cl.[7] ..... B63B 59/02

(52) U.S. Cl. ..... 114/220; 114/219; 114/364

(58) Field of Search ..... 114/220, 219, 114/364, 123, 343; 405/212, 213; 267/139, 140, 141.7; 293/1, 17, 18, 19, 20

(56) References Cited

U.S. PATENT DOCUMENTS

| | | | | |
|---|---|---|---|---|
| 212,143 | * | 2/1879 | Hulster | 114/220 |
| 281,280 | * | 7/1883 | McAllister | 114/220 |
| 799,645 | * | 9/1905 | Grimm | 114/220 |
| 980,964 | * | 1/1911 | Kalous | 114/67 R |
| 1,105,461 | * | 7/1914 | Shipman | 114/220 |
| 1,145,749 | * | 7/1915 | Claud | 114/219 |
| 1,182,400 | * | 5/1916 | Montanari | 114/220 |
| 1,416,155 | * | 5/1922 | Ahola | 114/140 |
| 2,761,410 | * | 9/1956 | Marr | 114/220 |
| 3,005,435 | * | 10/1961 | Roach | 114/220 |
| 3,084,517 | * | 4/1963 | Bell | 405/213 |
| 3,145,685 | * | 8/1964 | Kulick, Sr. | 114/220 |
| 3,163,410 | * | 12/1964 | Reid | 267/139 |
| 3,326,171 | * | 6/1967 | Zade | 114/220 |
| 3,528,383 | * | 9/1970 | Fetters | 114/220 |
| 3,709,183 | * | 1/1973 | Mace | 114/220 |
| 3,988,997 | | 11/1976 | Fenton | 114/219 |
| 4,841,893 | | 6/1989 | Ellison | 114/219 |
| 5,701,837 | | 12/1997 | Harvey | 114/219 |
| 6,021,729 | | 2/2000 | DeRuscio | 114/219 |
| 6,196,150 | * | 3/2001 | Fondacaro | 114/219 |

FOREIGN PATENT DOCUMENTS

| | | | | |
|---|---|---|---|---|
| 809950 | * | 4/1969 | (CA) | 114/219 |
| 2508744 | * | 9/1976 | (DE) | 114/220 |
| 52-007592 | * | 1/1977 | (JP) | 114/220 |
| 2-283592 | * | 11/1990 | (JP) | 114/219 |

* cited by examiner

*Primary Examiner*—S. Joseph Morano
*Assistant Examiner*—Ajay Vasudeva
(74) *Attorney, Agent, or Firm*—Donald Diamond

(57) ABSTRACT

A boat fender system and a method for deploying a cylindrical fender. The system includes a U-shaped member having a spindle on which is rotatably mounted a fender, and a lateral arm portion which is detachably connected to a locking assembly attached to a boat. The method includes mounting the fender to be freely rotatable about its longitudinal axis, and maintaining the fender in a vertical orientation and in a fixed position relative to the boat so that the fender comes into rolling contact with both the boat and a mooring structure.

5 Claims, 4 Drawing Sheets

BOAT FENDER SYSTEM AND METHOD

BACKGROUND OF THE INVENTION

1. Field of the Invention

This invention relates to boat fenders, and more particularly to a system including a fender which is rotatable on a spindle extending in a lateral arm detachably connected to a locking assembly permanently attached to the stem or gunwale of a watercraft.

2. Description of the Related Art

The purpose of a boat fender or bumper is to protect the stem, transom, hull, gunwale or bonding flange of a boat from being damaged when moored to a fixed or floating dock, slip, pier, piling or similar structure. As used herein, "fender" means a device which hangs over a stem or fantail or a gunwale, while "bumper" means a device, similar to a car bumper, attached to a gunwale, hull, stem or fantail. A fender or bumper also protects the mooring structure from being damaged by the boat. A moored boat does not remain stationary but floats up and down and back and forth in the water while banging, bumping and rubbing up against the mooring structure. As the amplitude and frequency of the waves increase, the pitching and rolling of the boat intensifies, increasing the likelihood that the boat will be damaged. Consequently, many recreational boaters consider fenders or bumpers to be necessary accessories.

A type of boat fender in wide use is in the form of a cylindrical, elongated tube, rounded at both ends and filled either with air or a cellular foam inner core to cushion and absorb the shock of the boat bumping and banging against the mooring structure. Typically, the fender has a nylon cord at its upper end which is tied to a cleat on the gunwale. The fender simply hangs down from the gunwale to protect the hull, or hangs over the stem to protect the transom. A disadvantage of this type of fender when a boat is moored at a dock is that as the boat pitches and rolls, the fender does not stay in place but is turned sideways or lifted up by the waves onto the deck, allowing the boat to go under the dock where it can suffer serious damage. U.S. Pat. No. 4,841,893 to R. P. Ellison discloses a fender which does not pop up, even under rough conditions. The fender has a cylindrical body and upper and lower pairs of encircling rings which project outwardly. The rings contact both the hull and dock. Motion of the boat relative to the dock causes a rolling motion of the fender which is either horizontal or slightly upwardly arcuate. The limited fender motion is due to the parallel tracking caused by the two pairs of rings and the length of the line tying the fender off to a cleat on the gunwale.

U.S. Pat. No. 3,988,997 is directed to a boat fender which is particularly suitable for protecting a hull during passage through a canal lock. The fender is formed from two elongated sheets of flexible fluid-tight material sealed together about their peripheries and divided by a transverse seal into an upper and a lower compartment. The upper compartment contains air and is thicker than the lower compartment which is filled with a heavier substance such as water and serves solely as a weight to keep the fender from being blown about.

Another type of boat fender designed especially for low freeboard craft such as fishing boats and ski boats has an L-shape. A large cylindrical portion hangs down from the gunwale and an integrally attached and orthogonal neck portion has an aperture through which a nylon cord is inserted for attaching the neck to a cleat. Because such fenders hang freely, they are susceptible in rough water to being tossed up onto the gunwale, leaving the boat unprotected. U.S. Pat. No. 5,701,837 to T. E. Harvey discloses a boat bumper which overcomes this problem. A rectangular-shaped member with flexible battens has a flexible upper portion resting on the gunwale, and a deformable body which can be conformably positioned contiguous to the hull. U.S. Pat. No. 6,021,729 discloses a "fender" which according to the terminology used herein is a bumper. The J-shaped fender has a hook portion shaped to hook under the bond flange of a personal watercraft, allowing easy attachment and detachment, and at least one flex portion conformable to both the front hull and rear section of the craft.

OBJECTS OF THE INVENTION

It is an object of the present invention to provide a boat fender system which permits a fender to be rapidly deployed from a preselected permanent location on a stem or fantail or a gunwale.

Another object of the invention is to provide a system which permits a fender to remain in the same position relative to the boat portion it protects regardless of sea state.

A further object of the invention is to provide a system which permits a fender to be quickly disconnected from an assembly rigidly attached to the boat.

Yet another object of the invention is to provide a system wherein a fender comes into rolling contact rather than frictional contact with the boat and mooring structure.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which provides in one aspect a boat fender system including: a marine fender having a longitudinal axis; means for mounting the fender to be freely rotatable about the axis and maintaining the fender in a preselected orientation and fixed position relative to a boat hull; and means for detachably connecting the fender to the boat.

In another aspect the invention provides a method for deploying a cylindrical fender from a boat. The method includes the steps of: mounting the fender to be freely rotatable about its longitudinal axis; and maintaining the fender in a generally vertical orientation and in a fixed position relative to the boat such that when the fender is interposed between the boat and a mooring structure the fender comes into rolling contact with the boat and structure.

In still another aspect the invention provides a boat fender system including a U-shaped member having a linear spindle portion, a linear elbow portion rigidly attached and orthogonal to the spindle portion, a leg portion rigidly attached and orthogonal to the elbow portion, and a linear lateral arm portion rigidly attached and orthogonal to the leg portion. The arm portion has an end and three holes proximate to the end spaced about 90 degrees apart. The system further includes a marine fender having a body portion cylindrical about a longitudinal axis and determined by a wall to which are circumferentially attached top and bottom portions each of which has a central hole. The holes are opposed ends of a tube disposed along the longitudinal axis. The spindle portion is closely received within the tube so that the fender is freely rotatable about the spindle portion.

The system further includes a locking assembly having a rectangular enclosure portion with a base, opposed longitudinal sides rigidly attached and orthogonal to the base, and opposed lateral sides having opposed central holes which are rigidly attached and orthogonal to the base and longitudinal sides. The base is rigidly attached to a boat at a preselected location. The enclosure portion is rigidly attached to an arm engagement portion having a horizontal bore and a vertical bore. The arm portion is received through the opposed central holes and within the horizontal bore where it is maintained in a preselected orientation by a retractable plunger tip disposed within the vertical bore and in penetrating contact with one of the arm portion holes.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
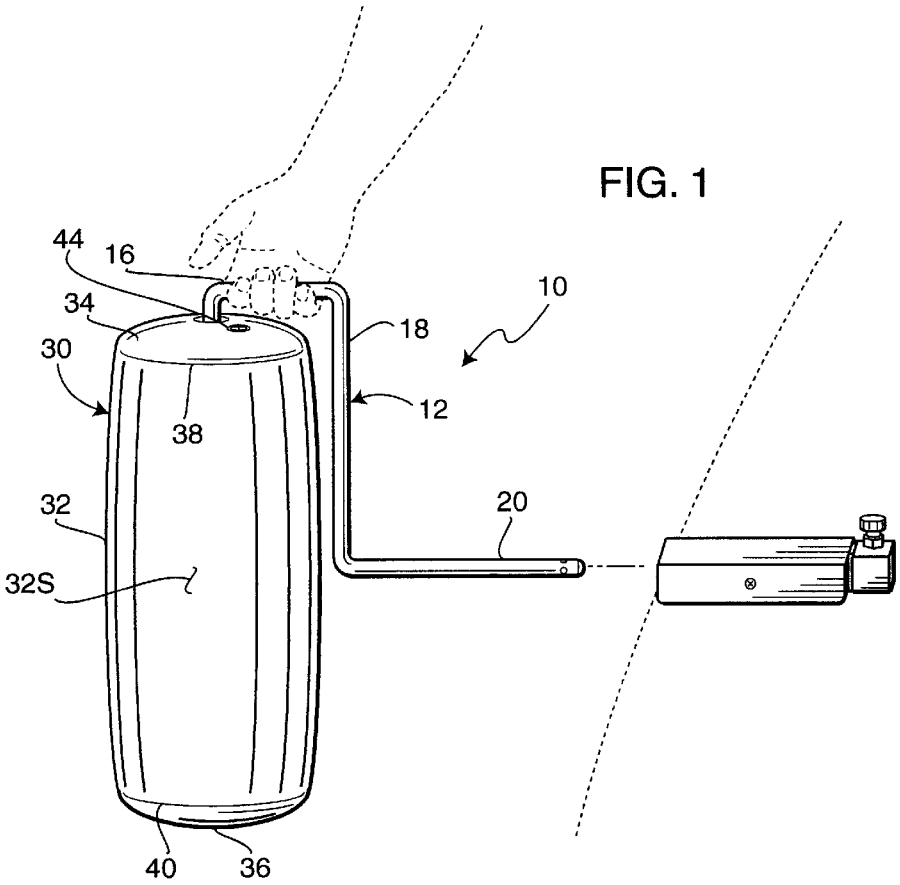
FIG. 1 is a perspective view of a boat fender system including a U-shaped member having a spindle on which an air-inflated fender is rotatably mounted, and a lateral arm received within a locking assembly attached to the boat.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the words "connected" and "connecting" mean that the two parts referred to (e.g., a lateral arm and a locking assembly) can be readily separated after being joined together in an interlocking combination. Where used herein, the word "attached" means that the two parts referred to are either fabricated in a single piece, screwed or bolted together, or joined in a combination that would not normally be disassembled (e.g., a fender and a spindle on which it is rotatably mounted). However, other forms of attachment may be suitable, consistent with simplicity of manufacture and reliability of operation.

Figure 2:
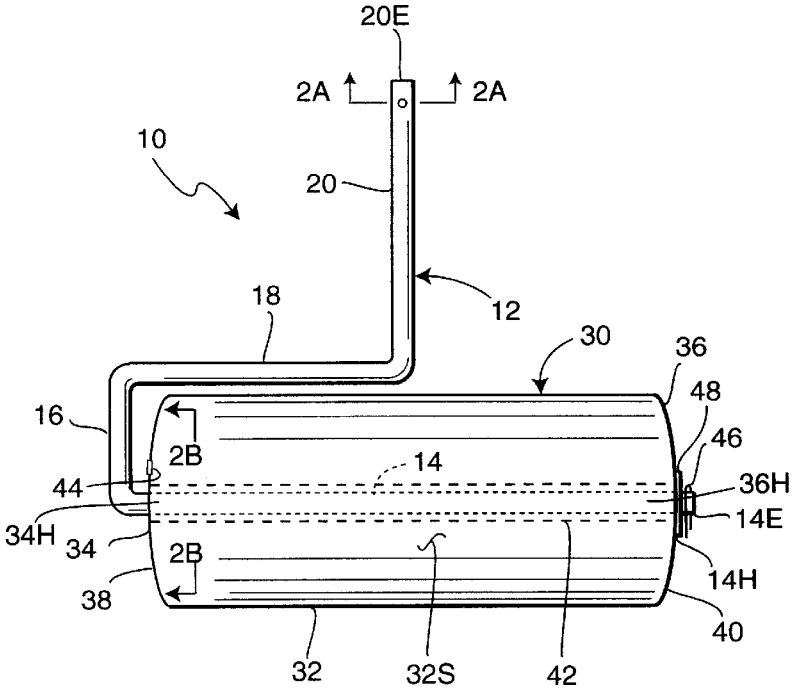
FIG. 2 is a plan view of the FIG. 1 U-shaped member and fender.
Figure 2A:
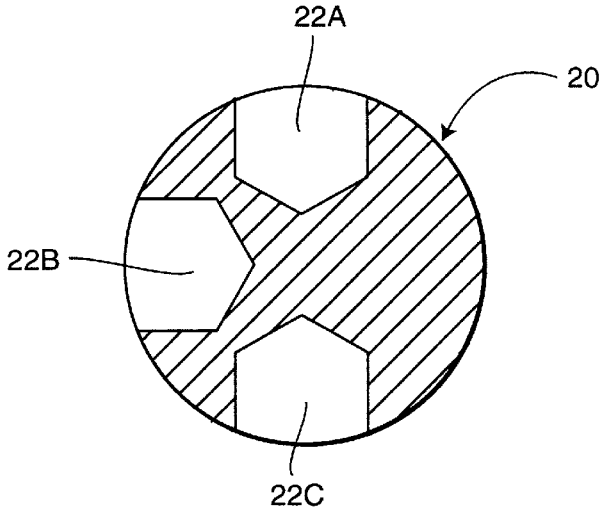
FIG. 2A is a sectional view taken along line 2A—2A in FIG. 2, showing an arm segment proximate to the arm end having three holes about 90° apart.

Referring to FIGS. 1 and 2, a boat fender system 10 according to the invention includes a U-shaped member 12 having a generally linear spindle portion 14 having an end 14E and a hole 14H therethrough proximate to end 14E, a generally linear elbow portion 16 rigidly attached and generally orthogonal to spindle portion 14, a generally linear leg portion 18 rigidly attached and generally orthogonal to elbow portion 16, and a generally linear lateral arm portion 20 rigidly attached and generally orthogonal to leg portion 18. Preferably, member 12 is made from a single piece of type 304 stainless steel round bar, ⅝-inch in diameter. Preferably, spindle portion 14, elbow portion 16, leg portion 18, and arm portion 20 are about 19¼, 4⅛, 9½, and 9 7/16 inches in length, respectively. Preferably, hole 14H is 7/64-inch in diameter and its center is 7/32-inch from end 14E. Referring to FIGS. 2 and 2A, arm portion 20 has an end 20E proximate to which are three holes 22A, 22B, 22C spaced about 90° apart. Preferably, the hole centers are ¾-inch from end 20E and the holes are ¼-inch in diameter and 5/32-inch deep.

Figure 2B:
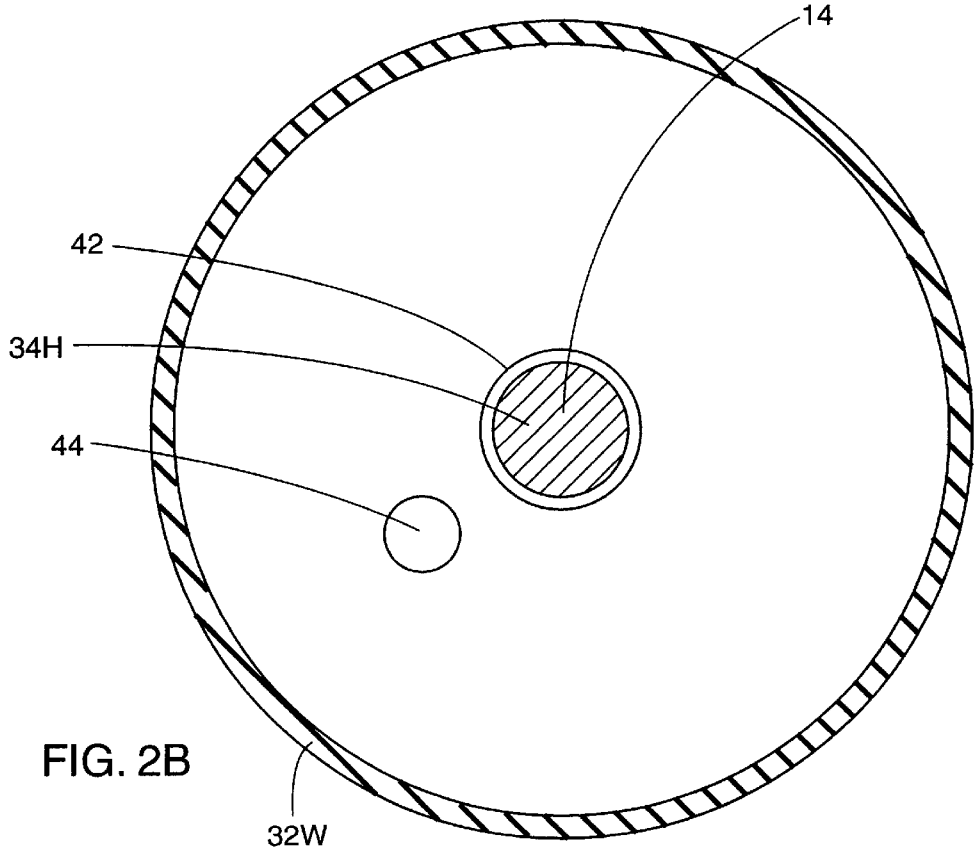
FIG. 2B is a cross-sectional view of the top portion of the FIG. 2 fender taken along line 2B—2B, showing a valve on the top portion, and the spindle closely received within a longitudinal tube.

Referring again to FIGS. 1 and 2, system 10 further includes an air-inflated marine fender 30 having a hollow body portion 32 generally cylindrical about a longitudinal axis and determined by a wall 32W of marine grade vinyl resin with an outer surface 32S, and generally convexly arcuate top and bottom portions 34, 36, respectively, circumferentially attached to wall 32W at watertight seams 38, 40, respectively. Referring to FIGS. 2 and 2B, portions 34 and 36 each have therethrough a central hole 34H, 36H, respectively, which are opposed ends of a tube 42 disposed along the axis. Top portion 34 has a valve 44 through which pressurized air is introduced to inflate body portion 32. Spindle portion 14 is closely received within tube 42 so that the fender 30 is freely rotatable about its longitudinal axis. Referring to FIG. 2, the fender is secured on the spindle portion by a cotter pin 46 inserted through hole 14H. A washer 48 is disposed between the pin and bottom portion 36. Preferably, holes 34H, 36H and tube 42 are slightly larger than ⅝-inch in diameter.

Fender 30 is commercially available as Model HTM-1 from Polyform U.S. Ltd. of Kent, Wash. and is about 6 inches in diameter and 15 inches in length. This size ("6×15") fender is suitable for boats up to 30 feet in length. It is evident that the dimensions of spindle 14 are readily scalable to accommodate larger fenders suitable for bigger boats. Typical dimensions of such fenders are: "8×20" for 25- to 45-foot boats; "10×26" for 40- to 60-foot boats; and "12×34" for 50- to 70-foot boats.

Figure 3:
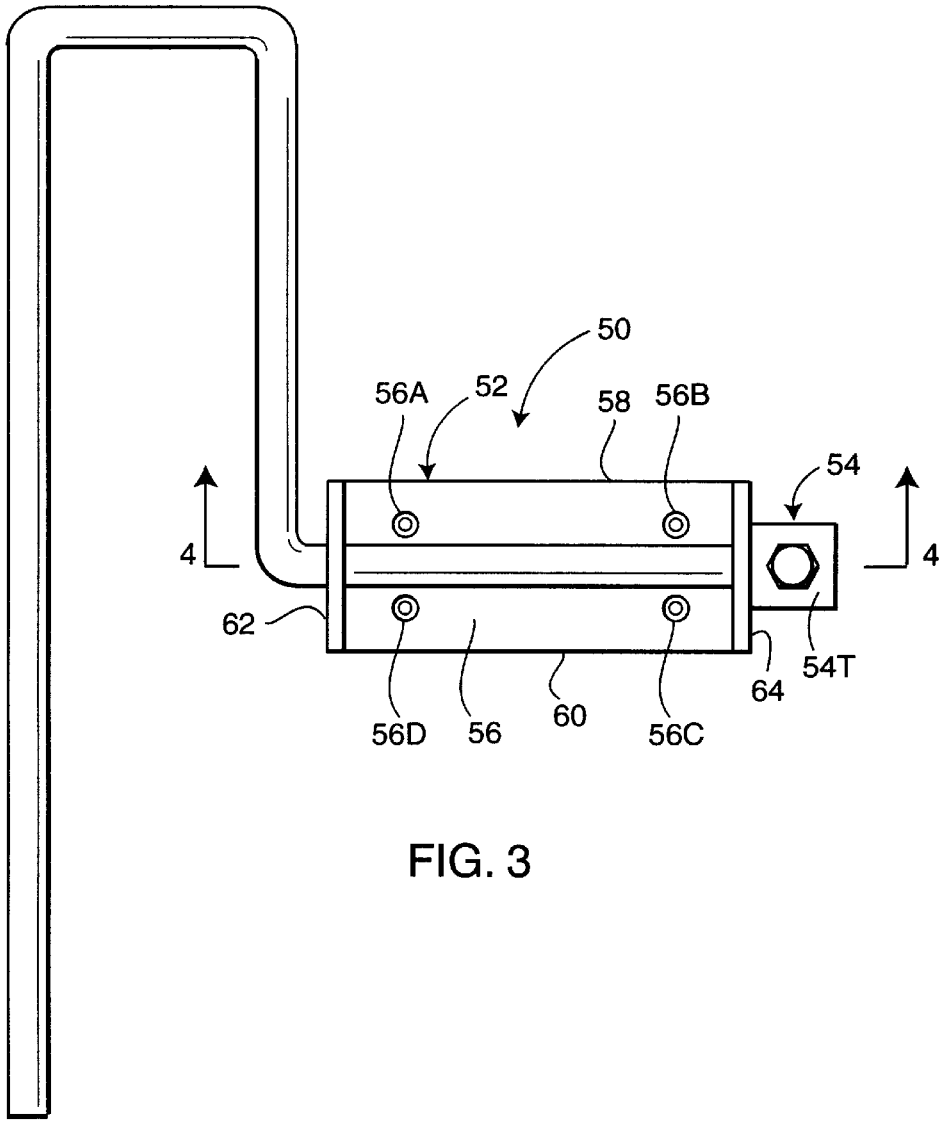
FIG. 3 is a top plan view of the FIG. 2 arm received within the locking assembly.
Figure 4:
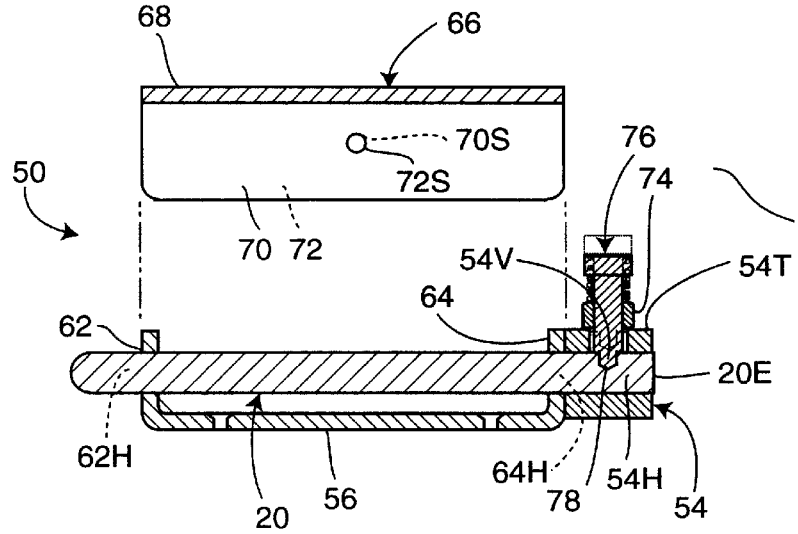
FIG. 4 is a sectional view of the FIG. 3 arm and locking assembly taken along the line 4—4, showing a spring plunger inserted into one of the FIG. 2A holes, and a detachable cover (not shown in FIG. 3).
Figure 5:
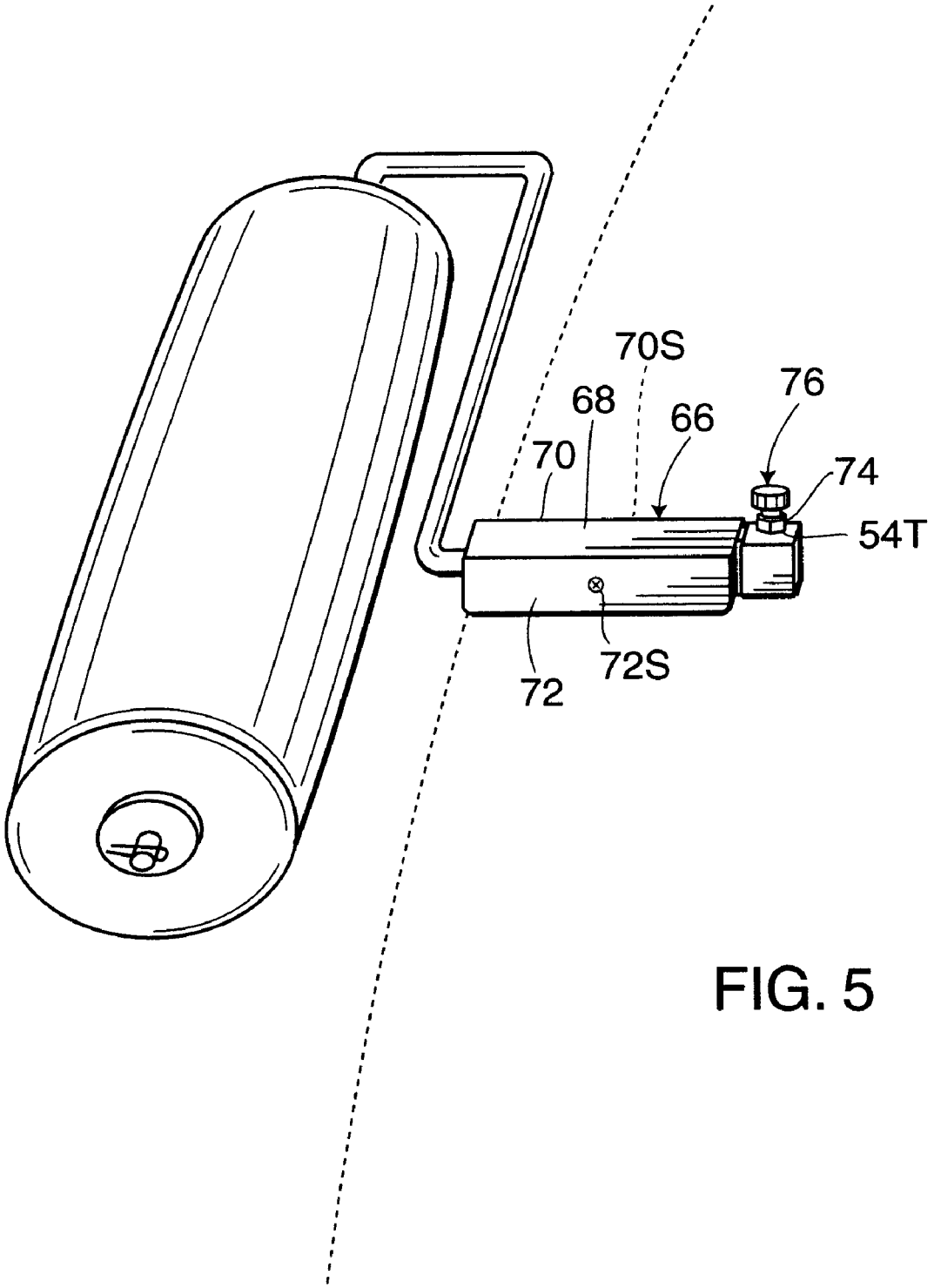
FIG. 5 shows the FIG. 1 system with the fender out of the water and in a stowed position.

Referring to FIGS. 3 and 4, system 10 further includes a locking assembly 50 having a generally rectangular enclosure portion 52 rigidly attached to a generally cubic arm engagement portion 54 having a top face 54T. Enclosure portion 52 has a base 56 with four symmetrically disposed holes 56A, 56B, 56C, 56D therethrough, opposed longitudinal sides 58, 60 rigidly attached and generally orthogonal to base 56, and opposed lateral sides 62, 64 rigidly attached and generally orthogonal to the base 56 and sides 58, 60. Sides 62, 64 have therethrough opposed central holes 62H, 64H, respectively. Base 56 is rigidly attached to the boat stern, fantail or gunwale at a preselected location by stainless steel screws through holes 56A–56D. Alternatively, bolt-and-nut combinations may be used. Referring to FIGS. 4 and 5, a removable U-shaped cover 66 having a top portion 68 and opposed longitudinal sides 70, 72 closely fits over and is secured to sides 58, 60 by screws 70S, 72S, respectively. Still referring to FIG. 4, engagement portion 54 has generally horizontal and vertical bores 54H, 54V, respectively. Referring again to FIGS. 4 and 5, a nut 74 rigidly attached to top face 54T receives and is attached to a spring-driven plunger 76 having a retractable tip 78. Nut 74 is aligned over bore 54V so the tip 78 when not retracted extends into bore 54H. Fender 30 is connected to locking assembly 50 by retracting tip 78, inserting end 20E of arm portion 20 through holes 62H and 64H into bore 54H so that so that one of the holes 22A, 22B, 22C is aligned with the tip, and then releasing the tip which is received within the hole. The choice of hole determines whether the fender is deployed in the generally vertical operational orientation with respect to the boat hull or transom, or as shown in FIG. 5, in a generally horizontal stowed orientation.

With the fender oriented vertically, when the boat is proximate to and bumps up against a mooring structure the interposed rotatable fender is brought into rolling contact with both the boat and structure. Thus, the boat transom or hull cannot abrade against the structure. The rigidity of the U-shaped member 12 ensures that the fender 30 cannot change its position relative to the boat no matter how violent the water motion.

What is claimed is:

1. A boat fender system comprising:

a U-shaped member having a generally linear spindle portion of a preselected length, a generally linear elbow portion of a preselected length rigidly attached and generally orthogonal to the spindle portion, a generally linear leg portion of a preselected length rigidly attached and generally orthogonal to the elbow portion, and a generally linear lateral arm portion of a preselected length rigidly attached and generally orthogonal to the leg portion, the arm portion having an end and three holes therein proximate to said end spaced about 90 degrees apart;

a marine fender of a preselected length and preselected diameter having a body portion generally cylindrical about a longitudinal axis and determined by a wall with a preselected thickness having an outer surface, and top and bottom portions each portion circumferentially attached to said wall and having a central hole therethrough, said holes being opposed ends of a tube disposed along said axis, said spindle portion closely received within the tube, the fender freely rotatable about the spindle portion; and a locking assembly having a generally rectangular enclosure portion having a base, opposed longitudinal sides rigidly attached and generally orthogonal to the base, and opposed lateral sides rigidly attached and generally orthogonal to the base and longitudinal sides, the lateral sides having therethrough opposed central holes, the base rigidly attached to a boat at a preselected location, the enclosure portion rigidly attached to a generally cubic arm engagement portion with a generally horizontal bore and a generally vertical bore, the arm portion received through said lateral side central holes and within the horizontal bore and maintained therein in a preselected orientation by a retractable plunger tip disposed within the vertical bore and in penetrating contact with one of said arm portion holes.

2. The system of claim 1, wherein:

said spindle portion length is about nineteen and one-quarter inches;

said elbow portion length is about four and one-eighth inches;

said leg portion length is about nine and one-half inches; and said arm portion length is about nine and seven-sixteenths inches.

3. The system of claim 1, wherein said fender body portion length is about fifteen inches and said fender body portion diameter is about six inches.

4. The system of claim 1, wherein the U-shaped member is fabricated from a unitary piece of type 304 stainless steel round bar, five-eighths inch in diameter.

5. The system of claim 1, wherein said boat location to which said enclosure portion base is attached is selected from the group consisting of locations on the boat stem, fantail, and gunwale.

* * * * *